United States Patent [19]

Soes

[11] Patent Number: 5,073,119

[45] Date of Patent: Dec. 17, 1991

[54] SURFACE MOUNT ELECTRICAL CONNECTOR

[75] Inventor: Lucas Soes, Rosmalen, Netherlands

[73] Assignee: AMP Incorporated, Harrisburg, Pa.

[21] Appl. No.: 507,344

[22] Filed: Apr. 10, 1990

[30] Foreign Application Priority Data

Apr. 13, 1989 [GB] United Kingdom ..... 8908411

[51] Int. Cl.[5] ..... H01R 13/428

[52] U.S. Cl. ..... 439/82; 439/751

[58] Field of Search ..... 439/78, 80, 81, 82, 439/84, 68, 70, 751, 873

[56] References Cited

U.S. PATENT DOCUMENTS

| | | | |
|---|---|---|---|
| 4,206,964 | 6/1980 | Olsson | 339/221 |
| 4,381,134 | 4/1983 | Anselmo et al. | 439/82 X |
| 4,698,026 | 10/1987 | Rolf | 439/751 |
| 4,828,503 | 5/1989 | Gilissen et al. | 439/82 |
| 4,857,018 | 8/1989 | Pickles | 439/82 X |

FOREIGN PATENT DOCUMENTS

| | | | |
|---|---|---|---|
| 0135988 | 3/1988 | European Pat. Off. . | |
| 0271357 | 6/1988 | European Pat. Off. | 439/82 |

*Primary Examiner*—Larry I. Schwartz
*Assistant Examiner*—Julie R. Daulton
*Attorney, Agent, or Firm*—Eric J. Groen

[57] ABSTRACT

An electrical connector is disclosed having electrical terminals mounted within an insulating housing where the electrical terminals comprise surface mount contacts, pin receiving contact arms, and retention legs. The retention legs comprise cutting sections which cut uniform width sections through an irregular shaped stamped printed circuit board through hole. The retention legs also include projections extending from the side edges of the retention legs and include ramped portions which have an overall width greater than the width between the stamped side edges. A stamped through section is defined in the retention legs which defines two spring members which are compliant and expandable to accommodate for heat expansion of the printed circuit board through holes.

16 Claims, 3 Drawing Sheets

SURFACE MOUNT ELECTRICAL CONNECTOR

BACKGROUND OF THE INVENTION

1. Field of the Invention

The subject of the invention relates to an electrical connector for the electrical interconnection of electronic devices having pin sections to the electrical traces on a printed circuit board.

2. Discussion of the Prior Art

The need has arisen in the electronics industry for an electrical interconnection system to a stamped printed circuit board where the stamped through holes of the printed circuit board are irregular in shape. In particular, the irregularity of the stamped terminals of the printed circuit board are defined by upper frusto-conical sections opening upwardly and lower frusto-conical sections opening downwardly from the printed circuit board. This irregular shape is due to the stamping dies which form the holes. Earlier attempts have been found to be quite useful for the electrical interconnection of this general nature, but have been found to be inadequate when used with the particular configuration of the stamped through holes of the printed circuit board.

Such an earlier attempt is shown in my European Patent Number 0 135 988 where the electrical connector shows a compliant section which is particularly useful for the interconnection and retention of the electrical connector to drilled through holes of a printed circuit board having a consistent cross-section. However, when this type of electrical connector is used with the stamped through hole having the upper frusto-conical sections opening upwardly, the compliant section can reside within the upper frusto-conical sections, and the compliancy of the terminal can actually act as a camming force, and force the connector away from the upper surface of the printed circuit board. Furthermore, the electrical connector described above has no means of cutting through the side walls of the stamped printed circuit board through holes to produce a uniform through hole. Furthermore, any attempts to use the leading edge of the terminal as a cutting surface is useless as the compliant sections do not track directly behind the leading edge of those terminals.

SUMMARY OF THE INVENTION

It is an object of the invention then, to design an electrical connection which can be used with a printed circuit board which has stamped through holes.

It is a further object of the invention to design an electrical connector having an improved retention system for printed circuit boards.

In general, the objects of the invention were accomplished by using an electrical terminal where a compliance section is formed by producing a stamped out section intermediate the side edges of the terminal leg producing two spring arms on opposite sides of the stamped out section.

This general type of electrical terminal, sometimes referred to as an "eye of the needle", is shown in U.S. Pat. No. 4,206,964 to Olssen and is characterized as an electrical connector having an insulating housing providing a mating face for interconnection of mating conductors and a mounting face for positioning adjacent to a printed circuit board. This connector has a plurality of electrical contacts positioned within the housing with first conductor contacting sections adjacent to the mating face and compliant interconnections sections extending from the lower face. The compliant interconnection sections comprise an edge stamped leg having a stamped out section in the leg forming two spring members on opposite sides of the stamped out section for resilient interconnection with a printed circuit board through hole.

The instant invention is characterized by the compliant interconnection sections including on at least one edge of the respective springs, a projection which extends beyond the vertical axes formed by the edges of the legs.

While the preferred embodiment of the invention is for the retention of the electrical connector to printed circuit boards, it is also conceivable that the compliant interconnection section can be used as an electrical interconnection of the terminal to plated through holes of the printed circuit board.

In the preferred embodiment of the invention the projection is defined by a ramped section which extends obliquely away from the free end of the compliant interconnection section.

In the preferred embodiment of the invention each side edge of the edge stamped leg comprises a projection.

In the preferred embodiment of the invention a shoulder is formed at the edge of the ramped section which is formed by a cupped section located above the ramped section.

In the preferred embodiment of the invention the stamped out section is defined as an elongate through hole.

In the preferred embodiment of the invention the edge stamped leg comprises two projections extending from each side edge.

In the preferred embodiment of the invention the projections are generally vertically centered relative to the stamped out section.

In the preferred embodiment of the invention the end of the edge stamped legs are wider than the through hole in the printed circuit board, and have cutting sections at their ends.

BRIEF DESCRIPTION OF THE DRAWINGS

FIG. 3 is an alternate embodiment of the electrical connector of FIGS. 1 and 2 which can be interconnected to a printed circuit board.

DETAILED DESCRIPTION OF THE PREFERRED EMBODIMENT

Figure 1:
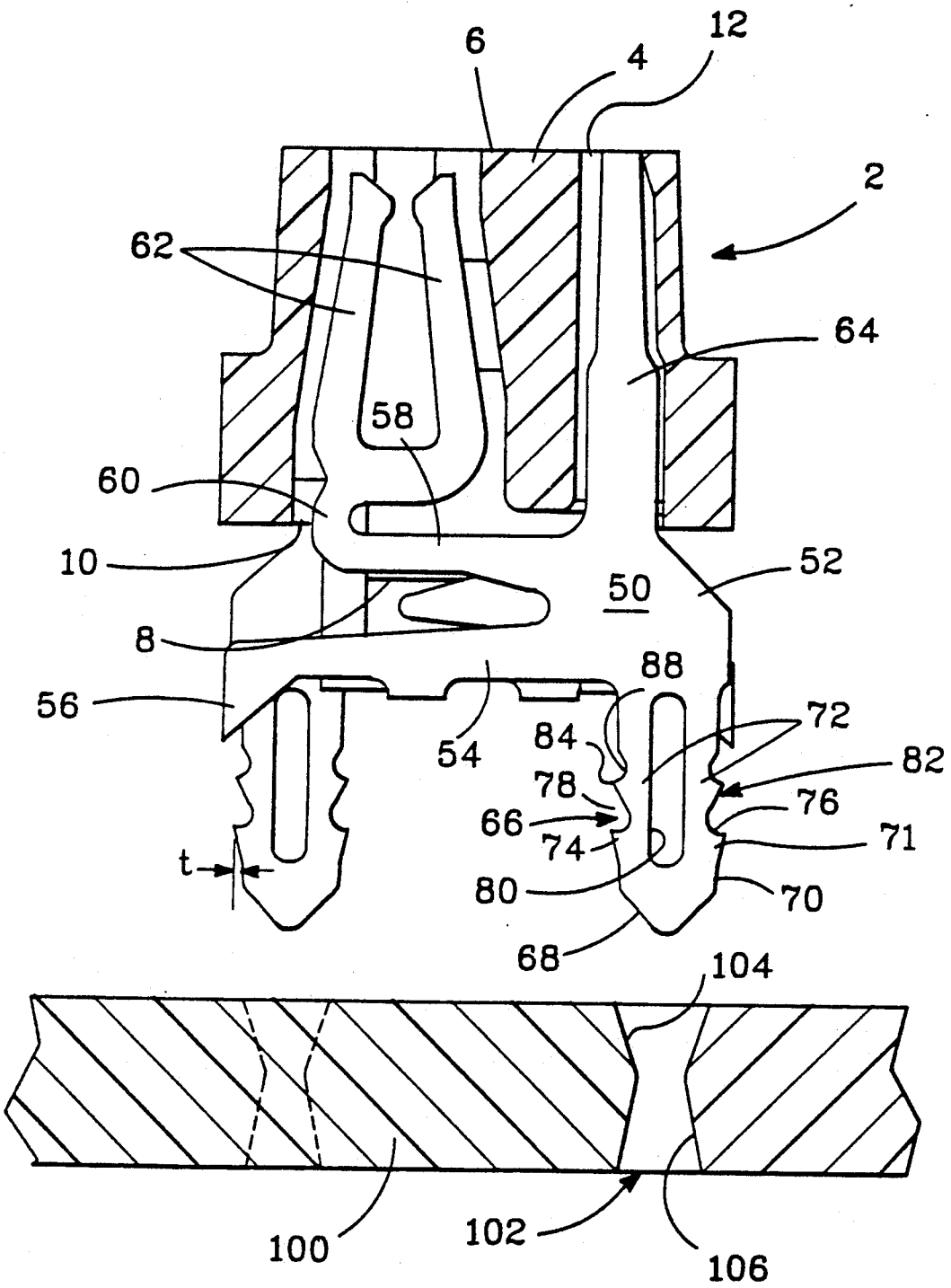
FIG. 1 is a side cross-sectional view through the electrical connector prior to insertion of the electrical connector to the printed circuit board.

An electrical connector shown in FIG. 1 which is surface mount compatible to a printed circuit board and which can receive a plurality of pin portions from a mating component. The electrical connector 2 generally comprises an insulating housing 4 having a plurality of electrical terminals 50 received within the housing. The electrical terminals comprise surface mount contacts 56 for the electrical interconnection of the terminals to traces on a printed circuit board and further comprise compliant contact arms 62 for receipt of the pin portions.

The electrical housing 4 generally comprises an upper mating face 6, a lower face 8, and a plurality of terminal receiving channels 10 extending between the upper mating face 6 and the lower face 8. The electrical housing 4 further comprises a plurality of apertures 12 for retention of the terminals within the housing.

The electrical terminals 50 generally comprise base sections 52 having a surface mount leg 54 extending from the base section, with a surface mount contact 56 extending downwardly towards a trace of the printed circuit board. The electrical terminals 50 further comprise contact legs 58 extending from the base section having compliant pin contact arms 62 interconnected to the contact leg 58 via a bight section 60. Retention legs 64 extend upwardly from the base section 52 for friction fit in an aperture 12 of the housing.

Interconnection sections 66 also extend downwardly from the base section 52 and includes a stamped out elongate section 80 which defines two compliant spring sections 72 on opposite sides of the elongate stamped out section 80. It should be noted that the terminals 50 are edge stamped which form sheared cutting edges 68 and sheared side edges 70 on the interconnection section 66. The terminals 50 further comprise a plurality of projections 82 extending from the side edges 70 of the edge stamped contacts 50. The projections 82 are formed by ramped sections 74 which extend upwardly at an oblique angle away from the cutting sections 68 of the terminal. Shoulders 76 are formed at the ends of the ramped sections, defined by cupped portions 78 above the ramp section 74. In the preferred embodiment of the invention a second set of projections 84 extend above the first set of projections 82 and also include shoulders 86 defined by cup portions 88.

As described above, the electrical connector 2 of the instant invention is for use with stamped printed circuit boards where the interconnection sections 66 can retain the electrical connector via through hole sections 102 in the printed circuit board, particularly when the stamped through holes 102 of the printed circuit board include upwardly formed sections 104 and lower formed sections 106, as shown in FIG. 1. As described above, other forms of electrical terminals have been found inadequate for the mechanical retention of such electrical connectors to printed circuit boards having the stamped through holes such as 102, however, the instant invention has proven to be most useful in such situations.

With the electrical connector 2 poised for receipt against the printed circuit board 100 as shown in FIG. 1, the cutting sections 68 engage the upper surface of the printed circuit board adjacent to the upper surface of the printed circuit board and downward force on the connector causes the cutting sections 68 to cut through the printed circuit board material. Furthermore, the improved spring portions of the terminals provide excellent mechanical retention of the connector to the printed circuit board preventing accidental removal of the connector thereby effecting the electrical integrity of the overall electronic device.

Figure 2:
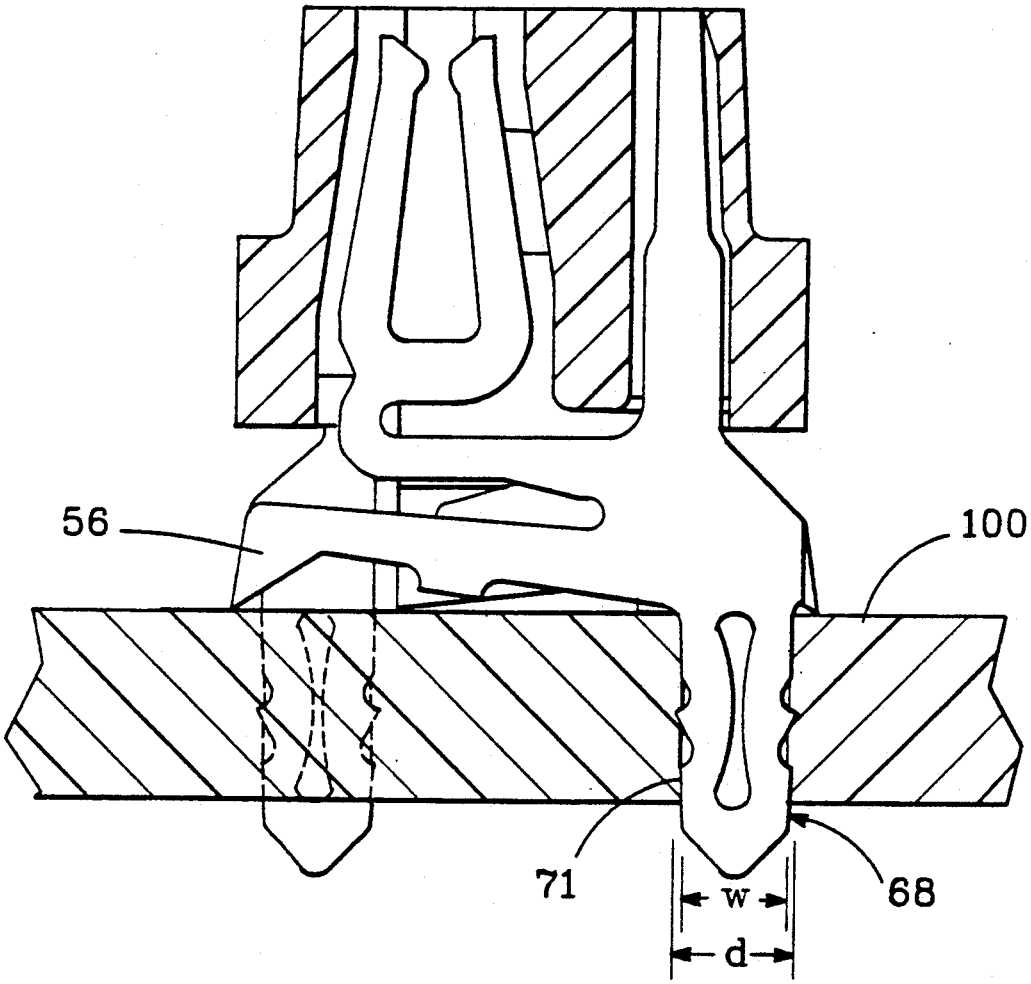
FIG. 2 is a view similar to that of FIG. 1 showing the electrical connector fully inserted into the printed circuit board.
Figure 7:
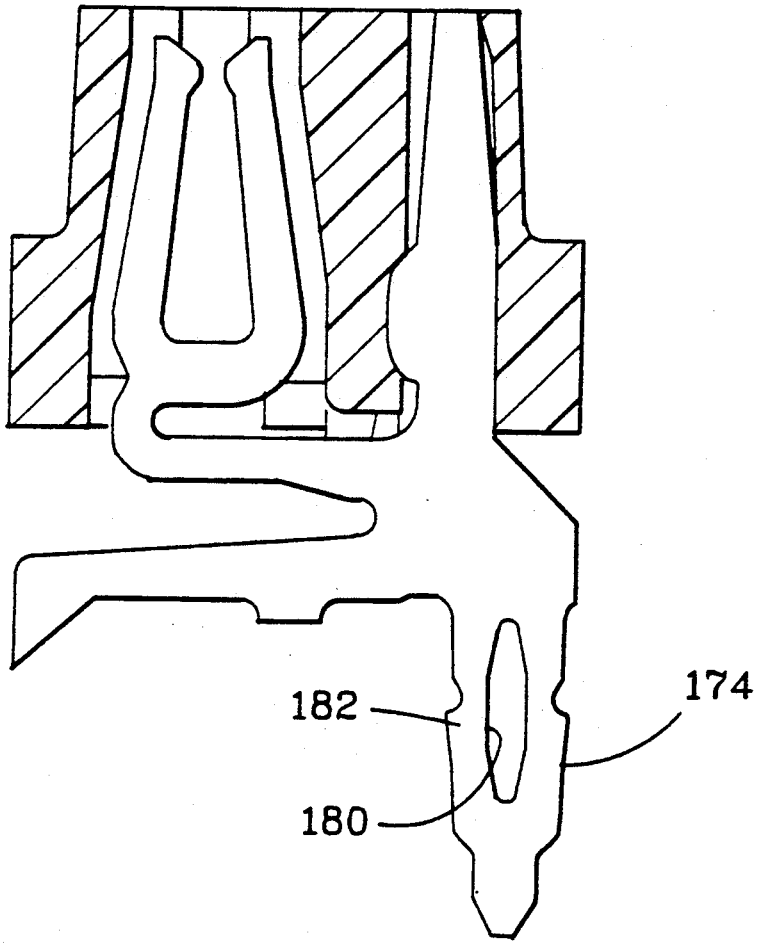

It should be noted from FIG. 1 that the projections 82 extend beyond the sheared side edges 70 of the interconnection legs by a distance t. When the connector 2 is inserted into the printed circuit board the cutting sections form a path into the through hole 102 as previously described until the electrical terminals are inserted a distance such that the corner 71, defined by the intersection of the sheared edge 70 and the ramped portion 74, meets the upper surface of the printed circuit board. At this point the ramped edges 74 do not cut into the printed circuit board any further, but rather cam the spring portions 72 inwardly to define bowed spring portions as shown in FIG. 2. Continued insertion of the connector into the printed circuit board continues the skiving or cutting action of the terminals into the through holes, however at a position leading the ramped portions 74.

The above mentioned interconnection section has been found to be most advantageous for atmospheres which may be subject to heat, thereby expanding the material which the printed circuit board is comprised of. For example, when the printed circuit board expands due to heating, the spring portions 72 are flexible enough to deflect outwardly and follow the expansion of the printed circuit through hole. This is due to the fact that the projections 82 extend beyond the vertical axis formed by the sheared edges 70. This allows each spring arm 72 to have a compliant movement equal to the distance t as shown in FIG. 1. Said differently, as the hole which is cut by the cutting surface 68 of the electrical terminal has a total width (w) equal to the width of the terminal between the sheared edges 70, the compliancy of the electrical terminal can accommodate an expansion of the printed circuit board a distance which is equal to the distance (d-w), as shown in FIG. 2.

It has also been found that the retention capabilities of the electrical terminals have been improved by the existence of the shoulder 76 formed at the end of each of the ramped sections 74 which tends to grip the side edge of through hole when an attempt is made to remove the electrical connector 2 from the printed circuit board.

In the preferred embodiment of the invention, the electrical connector is for use with printed circuit boards of a thickness equal to 1.5 mm. For such uses, the electrical terminals are designed as shown in FIGS. 1 and 2 where two projections 82 and 84 extend from each side edge 70 of the interconnection leg, and are generally vertically centered relative to the elongate stamped out section 80 which provides for the maximum compliancy of the spring arms 72.

However, the electrical connector concept as disclosed above can also be modified to accommodate thinner printed circuit boards generally in the range of 1 mm in thickness. In this case an electrical terminal shown in FIG. 3 is used having only one projection 182 defined by the ramped section 174, in which case the projection 182 is centered vertically relative to the stamped out section 180 of the terminal, such that when inserted into the printed circuit board the projection is generally vertically centered relative to the thickness of the printed circuit board.

What is claimed is:

1. An electrical connector for connection to a printed circuit board, comprising:

an insulating housing having a mating face for interconnection of mating conductors, and a lower face for positioning towards the printed circuit board;

a plurality of electrical contacts positioned within said housing with first conductor contacting sections adjacent to said mating face, surface mount contact portions extending from an edge stamped planar leg and positioned adjacent to the lower face, and compliant interconnection sections extending from said housing and below said lower face for retaining said housing to said printed circuit board, said edge stamped planar leg having a stamped out section extending through said leg defining an elongate opening forming two independently movable spring members on opposite sides of said opening, said spring members being resiliently flexible in a plane extending through said edge stamped planar leg, said compliant interconnection sections further comprising a projection on an outer side edge of at least one of said spring members, said projection extending beyond a vertical axis formed by said outer side edge, said contacts further comprising means for cutting slot-like passages in the printed circuit board, where the width of the passages is substantially equal to the width between said spring members' outer side edges, said compliant interconnection sections being adapted for resilient connection with the slot-like passages in the printed circuit board, said spring members being resiliently compressible and retractable to an extent equal to the difference between the width of the slot-like passages and the width between said outer side edges.

2. The electrical connector of claim 1, wherein said means for cutting is adjacent to a free end of said compliant interconnection section.

3. The electrical connector of claim 2 wherein said compliant interconnection sections further comprise gripping means adapted for retaining said connector to the printed circuit board.

4. The connector of claim 3, wherein said projection is formed by a ramped section extending obliquely away from said free end.

5. The connector of claim 4 wherein said gripping means is defined by a shoulder formed at an end of the ramped section.

6. The electrical connector of claim 5, wherein each said spring member comprises a projection extending from an outer side edge thereof.

7. An electrical connector, comprising:

an insulating housing providing a mating face for interconnection of mating conductors, and a lower face for positioning towards a printed circuit board;

a plurality of electrical edge stamped contacts positioned within said housing with first conductor contacting sections adjacent to said mating face, compliant interconnection sections extending from said housing and below said lower face, and surface mount contact portions, said compliant interconnection sections comprising an edge stamped leg having a stamped out section extending through said leg forming two independent spring members on opposite sides of said stamped out section for resilient interconnection with a printed circuit board through hole, at least one of said spring members including a projection on an outer side edge thereof, said projection extending beyond a vertical axis formed by said outer side edge, said leg further comprising cutting means adjacent to a free end of said compliant interconnection section for cutting through said printed circuit board, said at least one projection being laterally beyond said cutting means.

8. The electrical connector of claim 7 wherein said compliant interconnection sections further comprise gripping means adapted for retaining said connector to the printed circuit board.

9. The connector of claim 8, wherein said projection is formed by a ramped section extending obliquely away from said free end.

10. The electrical connector of claim 9 wherein said gripping means is formed by a shoulder formed at an end of said ramped section.

11. The electrical connector of claim 10 wherein said electrical contacts include a surface mount contact extending from said edge stamped leg.

12. The electrical connector of claim 11 wherein each spring member comprises a projection extending from an outer side edge thereof.

13. The electrical connector of claim 12 wherein said edge stamped leg comprises two projections extending from each outer side edge.

14. A printed circuit board retention member, comprising:

a plate-like compliant interconnection section having an edge stamped leg including an elongate stamped out through hole in the leg forming two spring members on opposite sides of the stamped out through hole;

cutting means at a free end of said leg adapted to shear a slot-like passage in a through hole of a printed circuit board, where the width of the slot-like passage is substantially equal to the width of the cutting means;

at least one projection on an outer side edge of at least one edge of one spring member, said projection extending laterally beyond said cutting means, and being engageable against a side edge formed in the slot-like passage, said projection being formed by a ramped section extending obliquely away from said free end, said ramped section being adapted to engage the side edge of the slot-like passage and urge the projection inwardly, said ramped section having a shoulder at an end thereof thereby forming gripping means adapted for gripping the through hole of the printed circuit board; and a surface mount contact extending from said edge stamped leg.

15. The electrical connector of claim 14 wherein each spring member comprises a projection extending from an outer side edge thereof.

16. The electrical connector of claim 14, wherein projections extend from each spring members side edge, said spring members being compressible and retractable to an extent equal to the difference between the width across the projections less the width across said spring members side edges.

* * * * *